US012521600B2

(12) United States Patent
Byun

(10) Patent No.: US 12,521,600 B2
(45) Date of Patent: Jan. 13, 2026

(54) TWO-WAY ROW MACHINE

(71) Applicant: NEWTECH WELLNESS CORPORATION, Gimhae-si (KR)

(72) Inventor: Hyun Jung Byun, Busan (KR)

(73) Assignee: NEWTECH WELLNESS CORPORATION, Gimhae-si (KR)

( * ) Notice: Subject to any disclaimer, the term of this patent is extended or adjusted under 35 U.S.C. 154(b) by 54 days.

(21) Appl. No.: 18/611,867

(22) Filed: Mar. 21, 2024

(65) Prior Publication Data

US 2024/0408441 A1 Dec. 12, 2024

(30) Foreign Application Priority Data

Jun. 8, 2023 (KR) ..... 10-2023-0073572

(51) Int. Cl.
*A63B 22/00* (2006.01)
*A63B 21/00* (2006.01)

(52) U.S. Cl.
CPC ..... *A63B 22/0076* (2013.01); *A63B 21/4034* (2015.10); *A63B 21/4035* (2015.10); *A63B 2022/0033* (2013.01); *A63B 2022/0035* (2013.01); *A63B 2022/0084* (2013.01)

(58) Field of Classification Search
CPC ..... A63B 22/0076; A63B 21/4034; A63B 21/4035; A63B 2022/0033; A63B 2022/0035; A63B 2022/0084; A63B 2208/0228; A63B 2225/09; A63B 2208/0252; A63B 2225/093
See application file for complete search history.

(56) References Cited

U.S. PATENT DOCUMENTS

| | | | | |
|---|---|---|---|---|
| 208,954 | A * | 10/1878 | Bryon, Jr. | A63B 22/0076 482/72 |
| 11,413,494 | B1 * | 8/2022 | Habing | A63B 21/225 |
| 12,311,226 | B2 * | 5/2025 | Byun | A63B 23/0233 |
| 2004/0038781 | A1 * | 2/2004 | Curtis | A63B 21/4035 482/904 |
| 2005/0032611 | A1 * | 2/2005 | Webber | A63B 23/1209 482/97 |
| 2006/0100066 | A1 * | 5/2006 | Maresh | A63B 22/0664 482/52 |
| 2007/0191191 | A1 * | 8/2007 | Fan | A63B 22/0076 482/72 |

(Continued)

FOREIGN PATENT DOCUMENTS

KR 10-0479725 B1 3/2005

*Primary Examiner* — Garrett K Atkinson
(74) *Attorney, Agent, or Firm* — Revolution IP, PLLC

(57) ABSTRACT

A two-way row machine includes a base frame arranged to be in contact with the bottom surface; a standing frame coupled to the upper surface of the base frame and arranged to stand in the vertical direction; a footrest unit seated on the upper surface of the base frame and supporting a user's feet; a support unit fixed to the standing frame and the footrest unit, supporting a user's body, and adjustable in standing angle and height; a pair of rotation units link-coupled to the base frame and disposed inclined toward both lower sides of the support unit; a pair of handle units coupled to one end of each of the pair of rotation units, formed for the user to hold it to rotate the rotation unit, and adjustable in angle; and a pair of rotation stopper units coupled to the base frame.

6 Claims, 11 Drawing Sheets

(56) References Cited

U.S. PATENT DOCUMENTS

| | | | | |
|---|---|---|---|---|
| 2009/0209395 | A1* | 8/2009 | Maresh | A63B 22/0012 482/52 |
| 2015/0141207 | A1* | 5/2015 | Eschenbach | A63B 22/001 482/52 |
| 2016/0107023 | A1* | 4/2016 | Campanaro | A63B 22/0076 482/72 |
| 2018/0117393 | A1* | 5/2018 | Ercanbrack | A63B 22/001 |
| 2019/0262654 | A1* | 8/2019 | Giannelli | A63B 23/1209 |
| 2020/0023232 | A1* | 1/2020 | French | A63B 22/0076 |
| 2022/0023707 | A1* | 1/2022 | Ellis | A63B 21/4047 |
| 2022/0096892 | A1* | 3/2022 | Arizmendez | A63B 22/0005 |
| 2023/0115159 | A1* | 4/2023 | Weller | A63B 24/0006 482/72 |

* cited by examiner

TWO-WAY ROW MACHINE

CROSS REFERENCE TO RELATED APPLICATIONS

This application claims priority to Korean Patent Application No. 10-2023-0073572 filed on Jun. 8, 2023, which is hereby incorporated by reference in its entirety.

BACKGROUND OF THE INVENTION

The present disclosure relates to a two-way row machine, and, more particularly, to a two-way row machine including a support unit that is adjustable in height and angle to suit each user's body and allowing a user to adjust the distance between his or her hands and a handle according to the height and angle of the support unit.

A bent over row is a weight training exercise that works the lats, and is a representative exercise for creating balanced back muscles. How to do a bent over row is as follows: Hold dumbbells with your both hands, bend your upper body forward about 80 degrees and slightly bend your knees, bend your arms and pull the dumbbells to the lower part of the pectoralis major muscle, and then return to the original position.

Because beginners have difficulty maintaining proper posture when doing a bent over rows using dumbbells, they may exercise in the wrong posture or put strain on their bodies while exercising and may frequently experience safety accidents such as missing a dumbbell.

As a result, exercise equipment to do a bent over row exercise has been disclosed, but the height and angle of the exercise equipment is fixed and not adjustable to each user's body size, resulting in low exercise efficiency.

Therefore, there is a need for research on a two-way row machine including a support unit that is adjustable in height and angle to suit each user's body and allowing a user to adjust the distance between his or her hands and a handle according to the height and angle of the support unit.

RELATED ART LITERATURE

Patent Literature (Patent Literature 1) Korean Patent No. 10-0479725

SUMMARY OF THE INVENTION

The present disclosure has been made in an effort to provide a two-way row machine including a support unit that is adjustable in height and angle to suit each user's body and allowing a user to adjust the distance between his or her hands and a handle according to the height and angle of the support unit.

The present disclosure has been made in an effort to provide a two-way row machine including a support unit that is adjustable in height and angle to suit each user's body size.

The present disclosure has been made in an effort to provide a two-way row machine allowing a user to adjust the distance between his or her hands and a handle through a rotation stopper unit.

The present disclosure has been made in an effort to provide a two-way row machine allowing a user to move a footrest unit to fit his or her own body size.

The present disclosure has been made in an effort to provide a two-way row machine allowing a user to change the kind of hand grip such as an over grip freely and conveniently as needed through a handle unit adjustable in angle.

The two-way row machine according to an embodiment of the present disclosure may include a base frame arranged to be in contact with the bottom surface; a standing frame coupled to the upper surface of the base frame and arranged to stand in the vertical direction; a footrest unit seated on the upper surface of the base frame and supporting a user's feet; a support unit fixed to the standing frame and the footrest unit, supporting a user's body, and adjustable in standing angle and height; a pair of rotation units link-coupled to the base frame and disposed inclined toward both lower sides of the support unit; a pair of handle units coupled to one end of each of the pair of rotation units, formed for the user to hold it to rotate the rotation unit, and adjustable in angle; and a pair of rotation stopper units coupled to the base frame, formed to be adjustable in height according to the difference in height of two different height protrusions, and supporting one point of the rotation unit.

The rotation stopper unit according to an embodiment of the present disclosure may include a link bracket coupled to one point of the base frame and formed in the shape of the Korean letter "ㄷ" a support axis penetrating the link bracket; a rotation link surrounding the support axis so as to be rotatable and formed in a hollow cylindrical shape; a first height protrusion protruding and extending from a point of the rotation link and formed to have a first length; a second height protrusion protruding and extending from another point of the rotation link, disposed at a preset angle with the first height protrusion, and formed to have a second length; a plurality of cushion portions respectively disposed on one end of each of the first height protrusion and the second height protrusion; a first support arranged to be spaced apart from the link bracket by a first distance; and a second support arranged to be spaced apart from the link bracket by a second distance in a direction opposite to the first support.

The footrest unit according to an embodiment of the present disclosure may include a main bent plate seated on the upper surface of the base frame and formed in the shape of a bent plate; a pair of support plates arranged on the lower surface of the main bent plate to be spaced apart from each other by a predetermined distance; a plurality of distance adjustment holes penetrating the main bent plate and the support plate; and a footrest module inserted and fixed into the distance adjustment hole and supporting a user's feet.

The footrest module according to an embodiment of the present disclosure may include a bottom plate seated on the upper surface of the main bent plate and formed in a plate shape; a pair of distance fixing units penetrating the bottom plate and inserted into the distance adjustment hole to determine the position at which the bottom plate is fixed; a bent plate fixed to the bottom plate, standing upright, bent at a right angle, and formed in a plate shape; an inclined plate fixed to one end of the bent plate at a preset angle and having a pair of protrusions at the upper end; and a footrest fixed to each of the protrusions and supporting a user's feet.

The support unit according to an embodiment of the present disclosure may include a link frame standing up from the footrest unit and formed to be inclined toward the upper part of the standing frame; a first support sheet fixed to the upper part of the link frame and formed to support the user's chest and abdomen; a second support sheet formed to support the user's buttocks; an angle adjuster coupled to one point of the standing frame and one end of the link frame and formed to adjust the angle of the link frame; and a height adjuster coupled to one side of the link frame and fixed to one side of the second support sheet to adjust the height of the second support sheet.

The height adjuster according to an embodiment of the present disclosure may include a pair of rack bars respectively coupled to either side of the link frame and having a plurality of grooves arranged in series; a roller module including a plurality of rollers in contact with the pair of rack bars and coupled to one surface of the first support sheet; a fixing board fixed to the roller module and inserted into at least one of the plurality of grooves to fix the positions of the first support sheet and the roller module; and an adjusting handle connected to the fixing board and determining whether the fixing board is inserted into the groove.

The two-way row machine according to an embodiment of the present disclosure may include a support unit that is adjustable in height and angle to suit each user's body and allow a user to adjust the distance between his or her hands and a handle according to the height and angle of the support unit.

The two-way row machine according to an embodiment of the present disclosure may include a support unit that is adjustable in height and angle to suit each user's body size.

The two-way row machine according to an embodiment of the present disclosure may allow a user to adjust the distance between his or her hands and a handle through a rotation stopper unit.

The two-way row machine according to an embodiment of the present disclosure may allow a user to move a footrest unit to fit his or her own body size.

The two-way row machine according to an embodiment of the present disclosure may allow a user to change the kind of hand grip such as an over grip freely and conveniently as needed through a handle unit adjustable in angle.

DETAILED DESCRIPTION OF THE INVENTION

Hereinafter, the specific embodiments of the present disclosure will be described in detail with reference to the drawings. However, the technology of the present disclosure is not limited to the presented embodiments. A person having ordinary skill in the art who understands the technology of the present disclosure would be able to easily suggest other embodiments within the technology of other regressive disclosures or the present disclosure by adding, changing, or removing components within the technology of the present disclosure, but such embodiments can also be deemed to fall within the scope of the technology of the present disclosure.

Hereinafter, a two-way row machine 100 according to the present disclosure will be described in detail with reference to the attached FIGS. 1 to 11.

Figure 1:
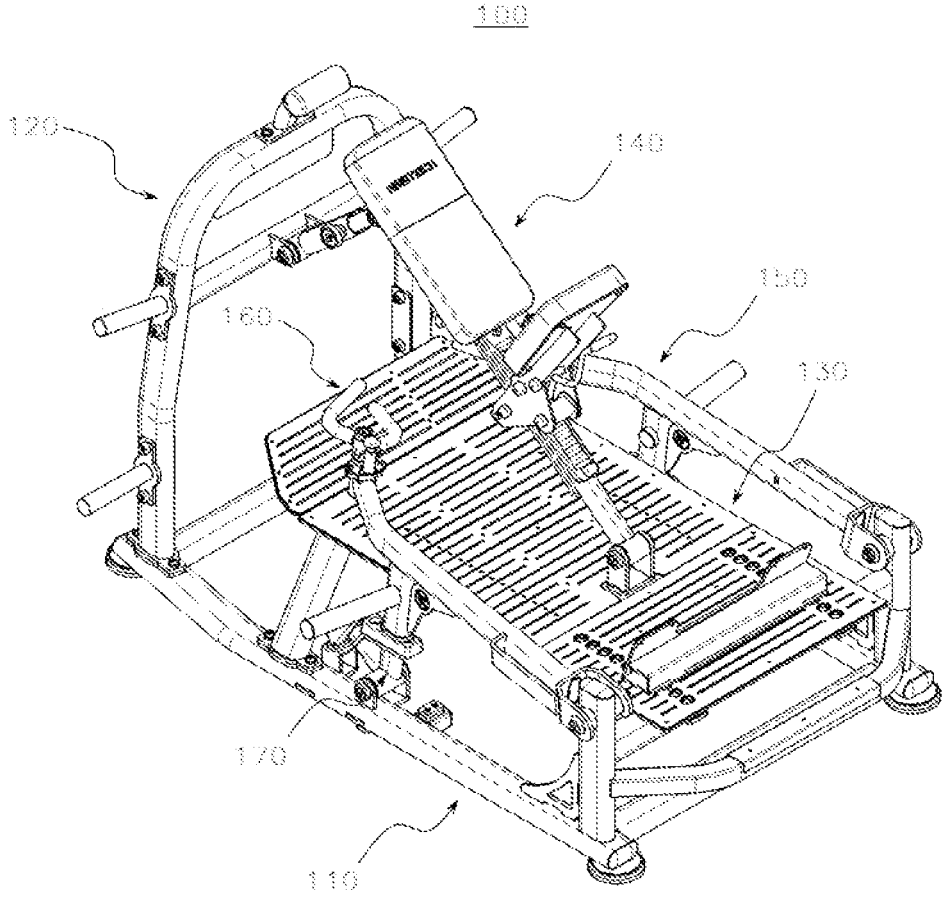
FIG. 1 is a view for illustrating a two-way row machine according to an embodiment of the present disclosure.

FIG. 1 is a view for illustrating the two-way row machine according to an embodiment of the present disclosure.

Referring to FIG. 1, the two-way row machine 100 according to an embodiment of the present disclosure may include a base frame 110, a standing frame 120, a footrest unit 130, a support unit 140, a rotation unit 150, a handle unit 160, and a rotation stopper unit 170.

The base frame 110 may be arranged to be in contact with the bottom surface. The base frame 110 will be examined in more detail with reference to FIG. 2.

Figure 2:
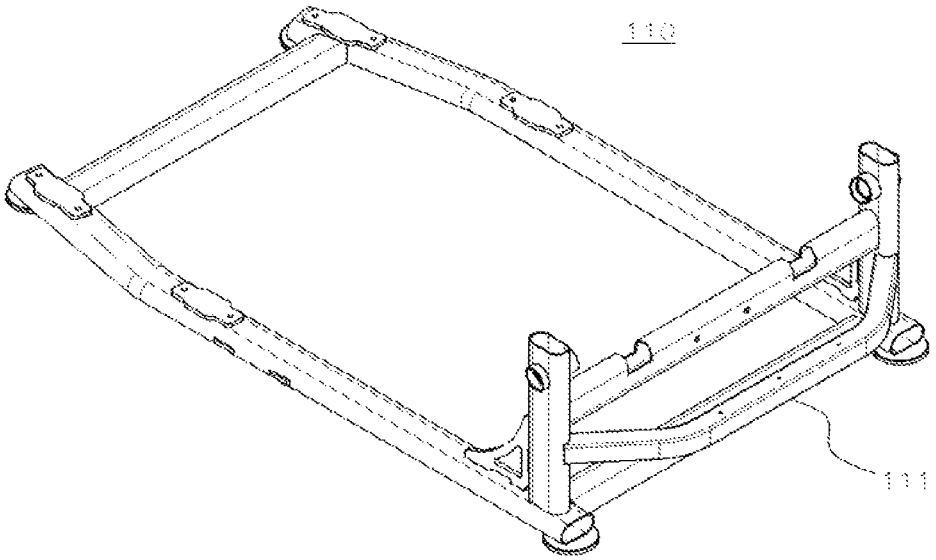
FIG. 2 is a view for illustrating a base frame according to an embodiment of the present disclosure.

FIG. 2 is a view for illustrating the base frame according to an embodiment of the present disclosure.

Referring to FIG. 2, the base frame 110 may include a stepping portion 111.

The stepping portion 111 may be coupled to one side for a user to step on it and climb up the support unit 140.

Referring back to FIG. 1, the standing frame 120 may be coupled to the upper surface of the base frame 110 and arranged to stand in the vertical direction. The standing frame 120 will be examined in more detail with reference to FIG. 3.

Figure 3:
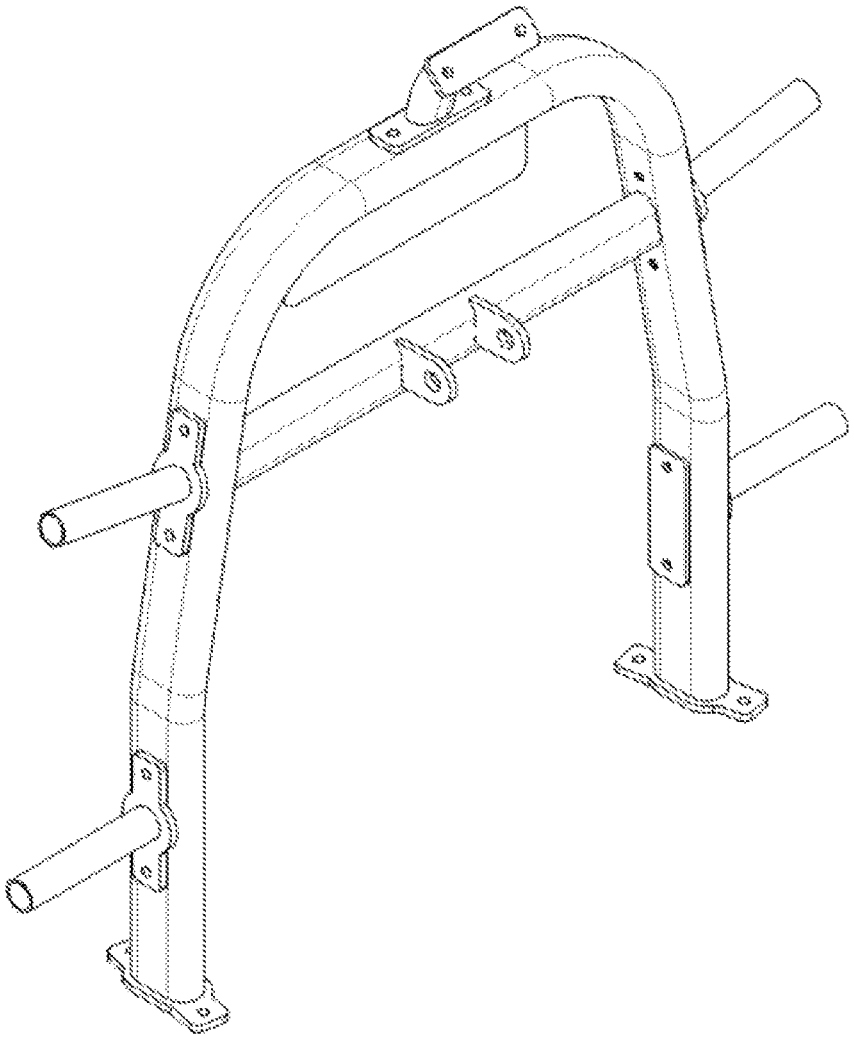
FIG. 3 is a view for illustrating a standing frame according to an embodiment of the present disclosure.

FIG. 3 is a view for illustrating the standing frame according to an embodiment of the present disclosure.

Referring to FIG. 3, the standing frame 120 may include a plurality of support bars (not shown).

Referring back to FIG. 1, the footrest unit 130 may be seated on the upper surface of the base frame 110 and may support a user's feet. The footrest unit 130 will be examined in more detail with reference to FIG. 4.

Figure 4:
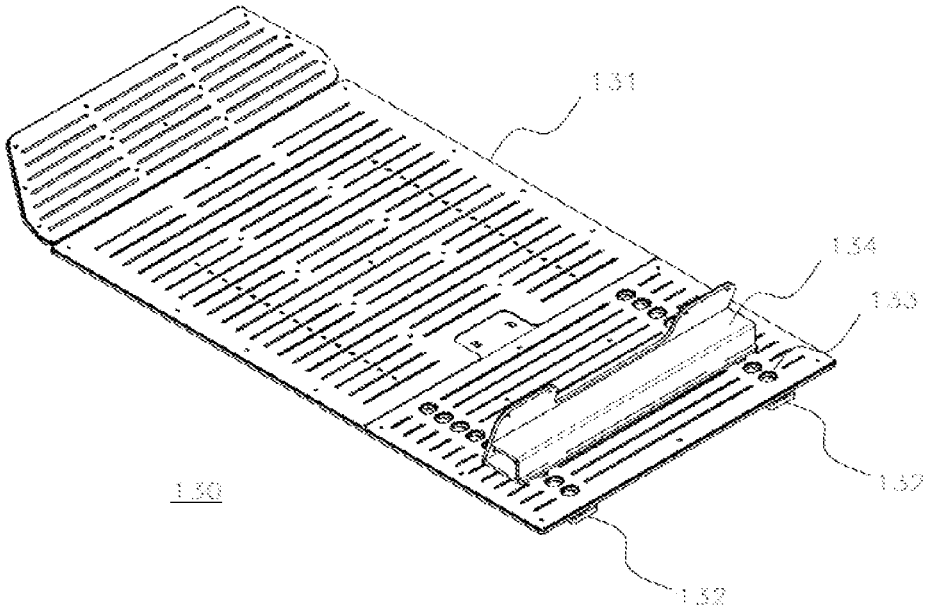
FIG. 4 is a view for illustrating a footrest unit according to an embodiment of the present disclosure.

FIG. 4 is a view for illustrating the footrest unit according to an embodiment of the present disclosure.

Referring to FIG. 4, the footrest unit 130 according to an embodiment of the present disclosure may include a main bent plate 131, a support plate 132, a distance adjustment hole 133, and a footrest module 134.

The main bent plate 131 may be seated on the upper surface of the base frame 110 and may be in the shape of a bent plate.

The support plate 132 may be arranged on the lower surface of the main bent plate 131 to be spaced apart from each other by a predetermined distance.

The distance adjustment hole 133 may penetrate the main bent plate 131 and the support plate 132.

The footrest module 134 may be inserted and fixed into the distance adjustment hole 133 and may support a user's feet. The footrest module 134 will be examined in more detail with reference to FIGS. 5 and 6.

Figure 5:
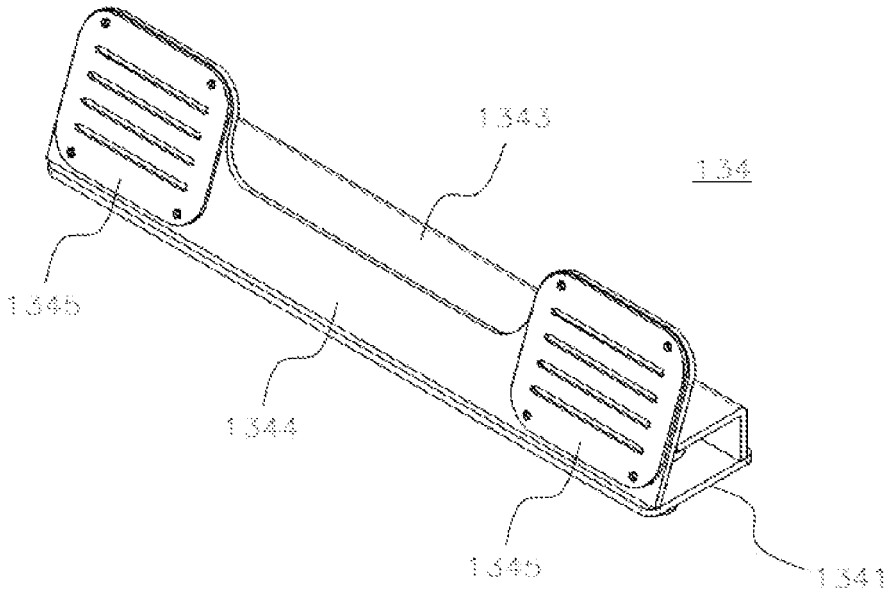
FIG. 5 is a perspective view for illustrating a footrest module according to an embodiment of the present disclosure.
Figure 6:
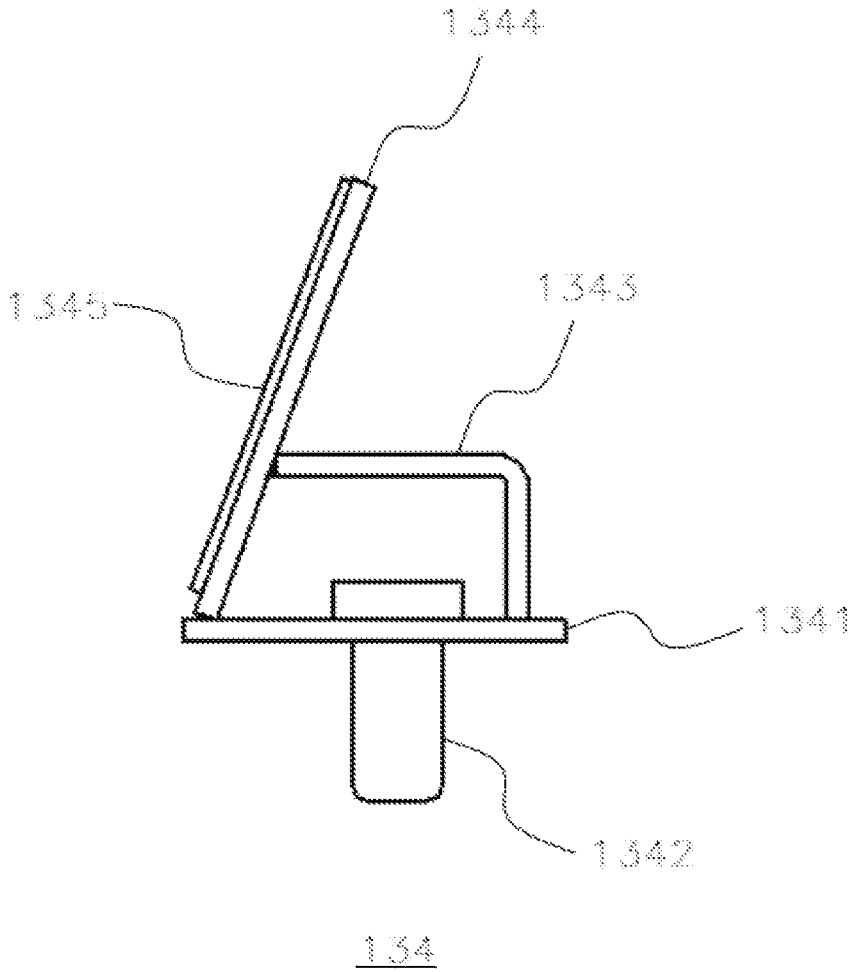
FIG. 6 is a side view for illustrating the footrest module according to an embodiment of the present disclosure.

FIG. 5 is a perspective view for illustrating the footrest module according to an embodiment of the present disclosure, and FIG. 6 is a side view for illustrating the footrest module according to an embodiment of the present disclosure.

Referring to FIGS. 5 and 6, the footrest module 134 according to an embodiment of the present disclosure may include a bottom plate 1341, a distance fixing unit 1342, a bent plate 1343, an inclined plate 1344, and a footrest 1345.

The bottom plate 1341 may be seated on the upper surface of the main bent plate 131 and may be in a plate shape.

The distance fixing unit 1342 may penetrate the bottom plate 1341 and may be inserted into the distance adjustment hole 133 to determine the position at which the bottom plate 1341 is fixed.

The bent plate 1343 may be fixed to the bottom plate 1341, stand upright, be bent at a right angle, and be in a plate shape.

The inclined plate 1344 may be fixed to one end of the bent plate 1343 at a preset angle and may have a pair of protrusions 13441 at the upper end.

The footrest 1345 may be fixed to each of the protrusions 13441 and may support a user's feet.

A plurality of slits (not shown) may be formed on the main bent plate 131 and the footrest 1345 to prevent a user from slipping.

Because the footrest module 134 may be formed to move, it may be possible to fit each user's body size.

Referring back to FIG. 1, the support unit 140 may be fixed to the standing frame 120 and the footrest unit 130, may support a user's body, and may be adjustable in standing angle and height. The support unit 140 will be examined in more detail with reference to FIG. 7.

Figure 7:
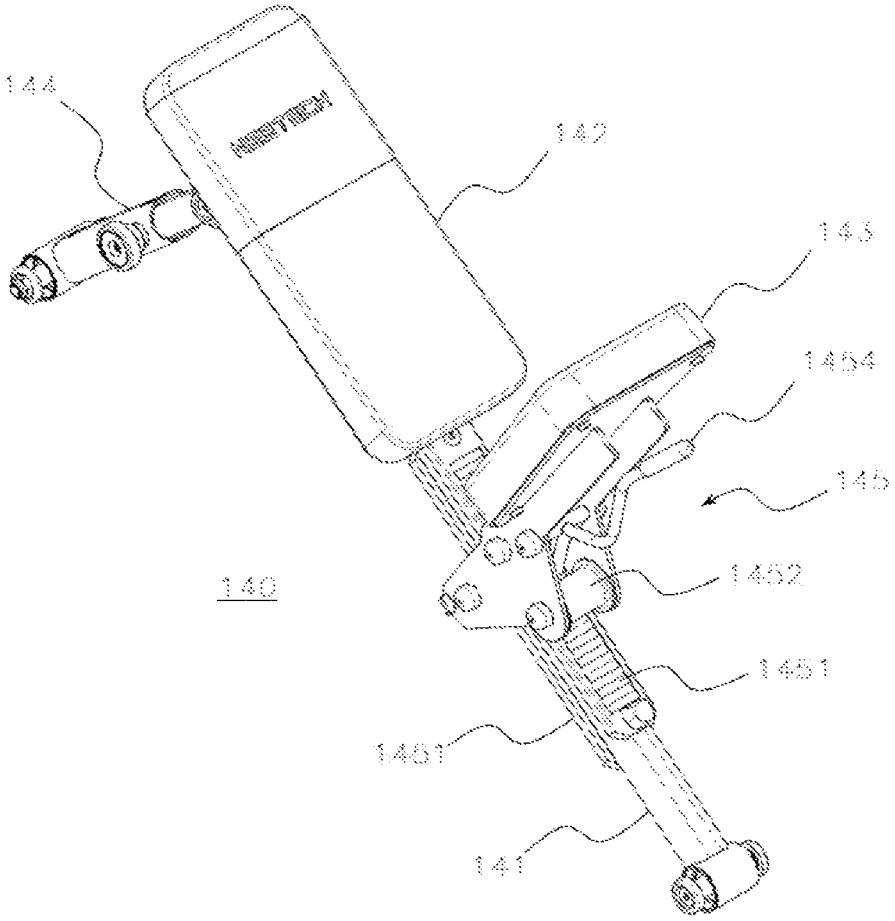
FIG. 7 is a view for illustrating a support unit according to an embodiment of the present disclosure.

FIG. 7 is a view for illustrating the support unit according to an embodiment of the present disclosure.

Referring to FIG. 7, the support unit 140 according to an embodiment of the present disclosure may include a link frame 141, a first support sheet 142, a second support sheet 143, an angle adjuster 144, and a height adjuster 145.

The link frame 141 may stand up from the footrest unit 130 and may be formed to be inclined toward the upper part of the standing frame 120.

The first support sheet 142 may be fixed to the upper part of the link frame 141 and may be formed to support the user's chest and abdomen.

The second support sheet 143 may be formed to support the user's buttocks.

The angle adjuster 144 may be coupled to one point of the standing frame 120 and one end of the link frame 141, and may be formed to adjust the angle of the link frame 141. The angle adjuster 144 will be examined in more detail with reference to FIG. 8.

Figure 8:
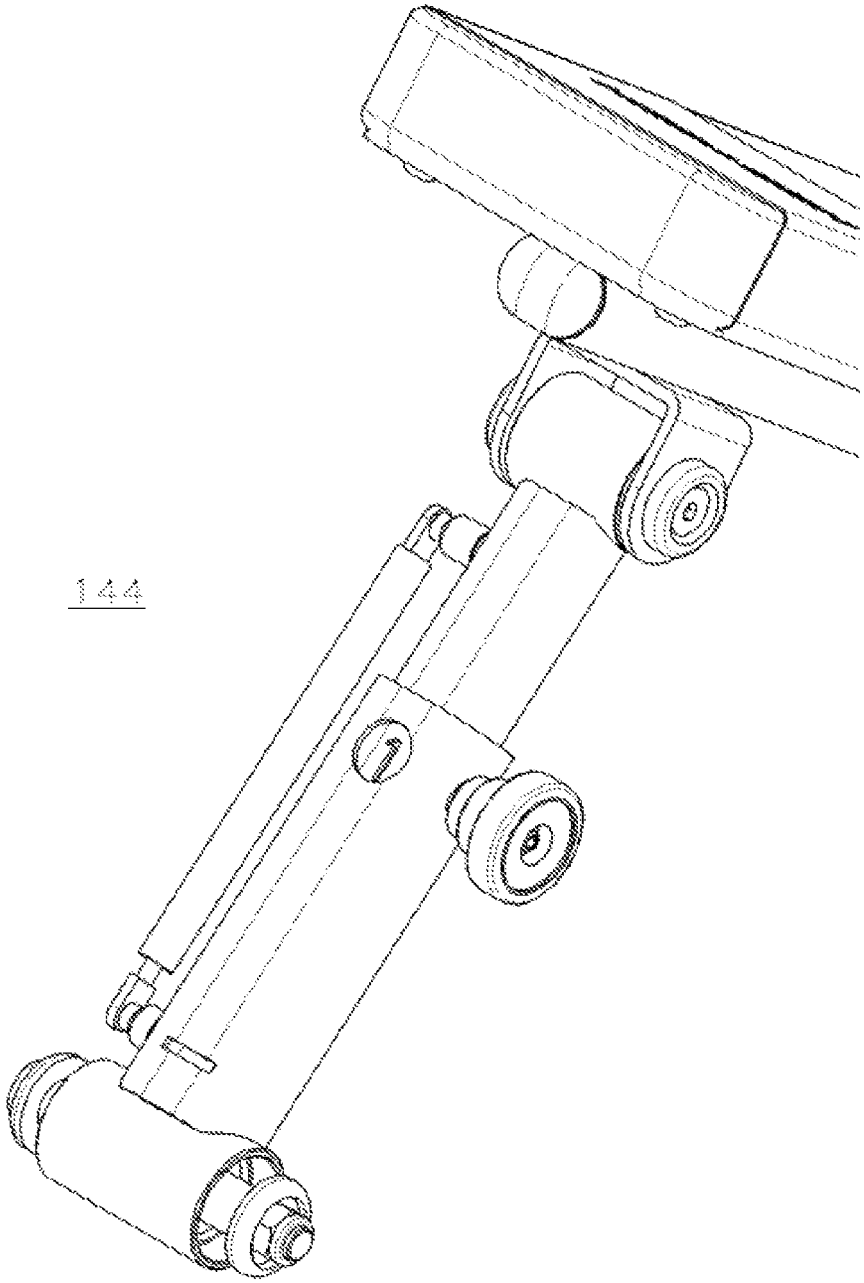
FIG. 8 is a view for illustrating an angle adjuster according to an embodiment of the present disclosure.

FIG. 8 is a view for illustrating the angle adjuster according to an embodiment of the present disclosure.

Referring to FIG. 8, the angle of the angle adjuster 144 according to an embodiment of the present disclosure may be adjusted by fixing a pin to a desired hole.

Referring back to FIG. 7, the height adjuster 145 may be coupled to one side of the link frame 141, and may be fixed to one side of the second support sheet 143 to adjust the height of the second support sheet 143. The height adjuster 145 will be examined in more detail with reference to FIG. 9.

Figure 9:
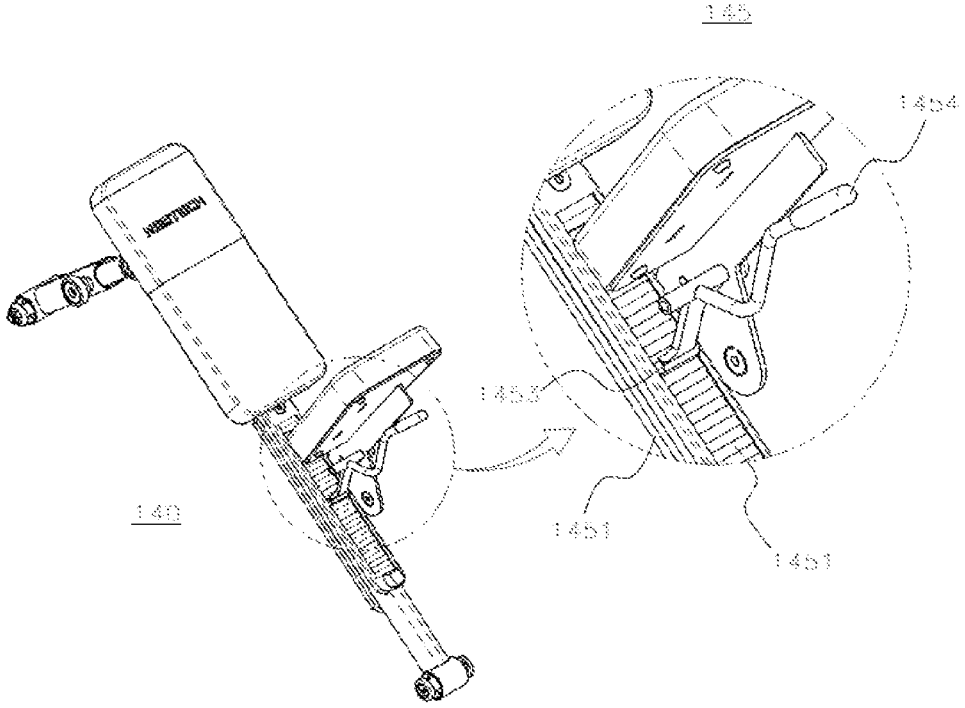
FIG. 9 is a view for illustrating a height adjuster according to an embodiment of the present disclosure.

FIG. 9 is a view for illustrating the height adjuster according to an embodiment of the present disclosure.

Referring to FIG. 9, the height adjuster 145 according to an embodiment of the present disclosure may include a rack bar 1451, a roller module 1452, a fixing board 1453, and an adjusting handle 1454.

The rack bar 1451 may be coupled to either side of the link frame 141, and a plurality of grooves may be arranged in series thereon.

The roller module 1452 may include a plurality of rollers in contact with the pair of rack bars 1451 and may be coupled to one surface of the first support sheet 142.

The fixing board 1453 may be fixed to the roller module 1452, and may be inserted into at least one of the plurality of grooves to fix the positions of the first support sheet 142 and the roller module 1452.

The adjusting handle 1454 may be connected to the fixing board 1453 and may determine whether the fixing board 1453 is inserted into the groove.

Because the support unit 140 may be adjustable in height and angle, it may be possible for a user to improve exercise efficiency by selecting an exercise posture suitable for muscles to be stimulated.

Referring back to FIG. 1, the rotation unit 150 may be link-coupled to the base frame 110, and may be disposed inclined toward both lower sides of the support unit 140. The rotation unit 150 will be examined in more detail with reference to FIG. 10.

Figure 10:
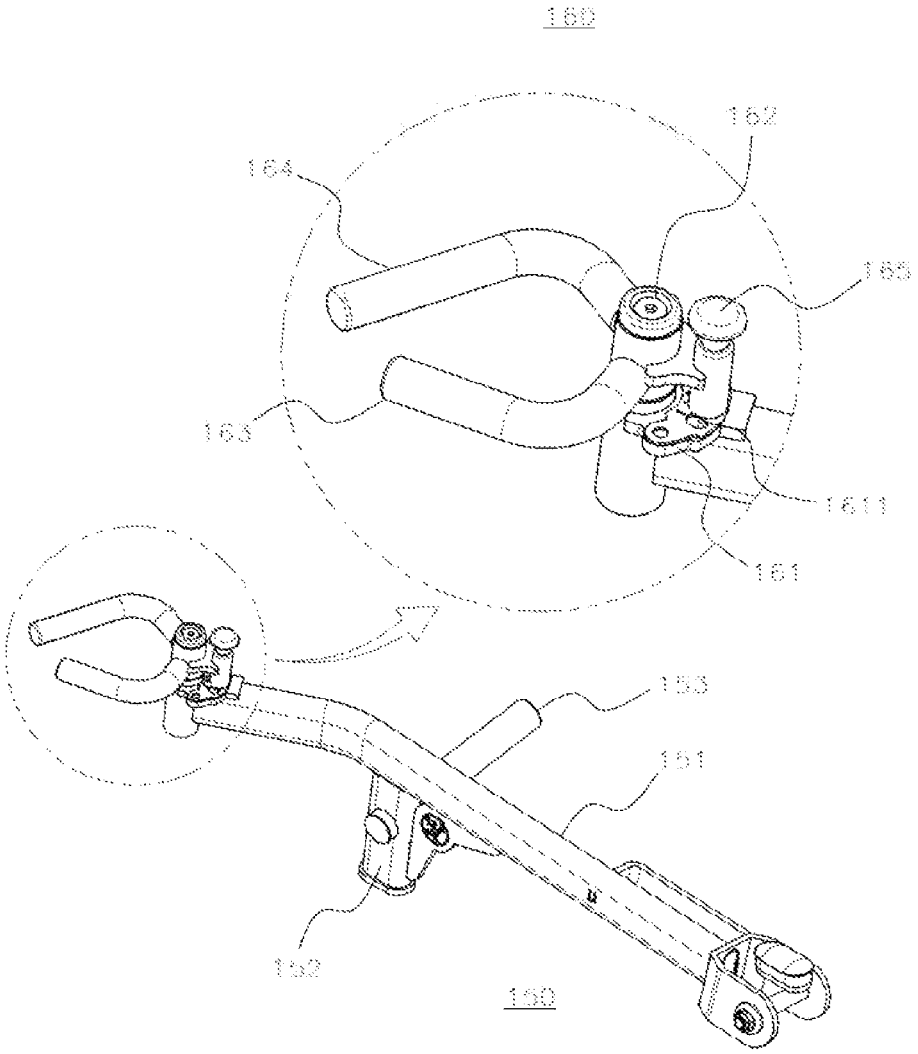
FIG. 10 is a view for illustrating a rotation unit and a handle unit according to an embodiment of the present disclosure.

FIG. 10 is a view for illustrating the rotation unit and the handle unit according to an embodiment of the present disclosure.

Referring to FIG. 10, the rotation unit 150 according to an embodiment of the present disclosure may include a bent frame 151, a support frame 152, and a mounting bar 153.

One end of the bent frame 151 may be link-coupled to the base frame 110 and may be bent at a first angle.

The support frame 152 may extend vertically from one point of the bent frame 151, may be formed in a bar shape, and may be seated on the upper surface of a cushion portion 176.

The mounting bar 153 may protrude from one point of the support frame 152 and may be arranged to secure a heavy object.

The handle unit 160 may be coupled to one end of each of the pair of rotation units 150 and may be adjustable in angle, and a user may hold it to rotate the rotation unit 150. The handle unit 160 may include an angle adjustment plate 161, a rotation axis 162, a first handle 163, a second handle 164, and an angle fixing pin 165.

The angle adjustment plate 161 may be coupled to one end of the bent frame 151 and may include a plurality of angle adjustment holes 1611.

The rotation axis 162 may be fixed to one side of the angle adjustment plate 161.

The first handle 163 may be formed in the shape of a bent pipe, and one end thereof may be fixed to the rotation axis 162.

The second handle 164 may be formed in the shape of a bent pipe, and one end thereof may be fixed to the rotation axis 162.

The angle fixing pin 165 may be coupled to the rotation axis 162 and rotate around the rotation axis 162, and may be inserted into the angle adjustment hole to fix the angles of the first handle 163 and the second handle 164.

Because the handle unit 160 may be adjustable in angle, it may be possible for a user to work out with a handle at an angle most optimized for his or her posture and to change the kind of hand grip such as an over grip freely and conveniently as needed.

Referring back to FIG. 1, the rotation stopper unit 170 may be coupled to the base frame 110, may be formed to be adjustable in height according to the difference in height of two different height protrusions 174 and 175, and may support one point of the rotation unit 150. The rotation stopper unit 170 will be examined in more detail with reference to FIG. 11.

Figure 11:
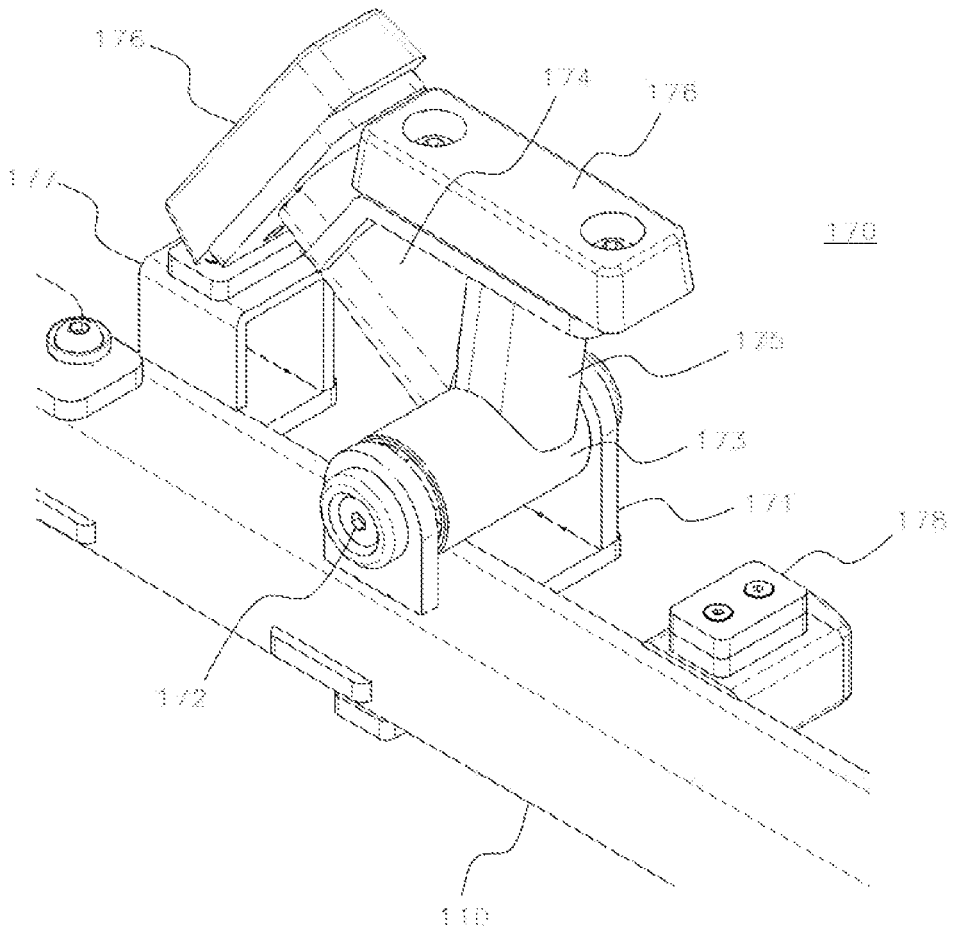
FIG. 11 is a view for illustrating a rotation stopper unit according to an embodiment of the present disclosure.

FIG. 11 is a view for illustrating the rotation stopper unit according to an embodiment of the present disclosure.

Referring to FIG. 11, the rotation stopper unit 170 according to an embodiment of the present disclosure may include a link bracket 171, a support axis 172, a rotation link 173, a first height protrusion 174, a second height protrusion 175, a cushion portion 176, a first support 177, and a second support 178.

The link bracket 171 may be coupled to one point of the base frame 110 and may be formed in the shape of the Korean letter "ㄷ" The support axis 172 may penetrate the link bracket 171.

The rotation link 173 may surround the support axis 172 so as to be rotatable and may be formed in a hollow cylindrical shape.

The first height protrusion 174 may protrude and extend from a point of the rotation link 173 and may be formed to have a first length.

The second height protrusion 175 may protrude and extend from another point of the rotation link 173, may be disposed at a preset angle with the first height protrusion 174, and may be formed to have a second length.

The cushion portion 176 may be disposed on one end of each of the first height protrusion 174 and the second height protrusion 175.

The first support 177 may be arranged to be spaced apart from the link bracket 171 by a first distance.

The second support 178 may be arranged to be spaced apart from the link bracket 171 by a second distance in a direction opposite to the first support 177.

The rotation stopper unit 170 may be rotated according to the adjusted height and angle of the support unit 140 so that the rotation unit 150 may be supported with either the first height protrusion 174 or the second height protrusion 175. Through the rotation stopper unit 170, it may be possible to adjust the distance between a user's hands and the handle unit 160.

Hereinafter, the operation of the two-way row machine 100 according to the present disclosure will be described with reference back to FIGS. 1 to 11.

It may be possible for a user to step on the stepping portion 111 to stand on the footrest unit 130. It may be possible to adjust the height and angle of the support unit 140 as desired after moving the footrest module 134 to suit a user's height. The rotation stopper unit 170 may be rotated according to the height and angle of the support unit 140 to support the rotation unit 150 at an appropriate height. In addition, it may be possible to adjust the angle of the handle unit 160. It may be possible for a user to work out by sitting or lying on the support unit 140 and rotating the rotation unit 150 after adjusting each component to suit his or her body size or situation.

As examined above, according to an embodiment of the present disclosure, it may be possible to provide a support unit that is adjustable in height and angle to suit each user's body and to adjust the distance between a user's hands and a handle according to the height and angle of the support unit.

In addition, in the case of the two-way row machine according to an embodiment of the present disclosure, it may be possible to adjust the height and angle of the support unit according to the body size of each user and to adjust the distance between a user's hands and the handle through the rotation stopper unit.

Furthermore, it may be possible to move the footrest unit to suit the body size of each user and to change the kind of hand grip such as an over grip freely and conveniently as needed through the handle unit adjustable in angle.

One embodiment of the present disclosure has been described with limited examples and drawings, but is not limited to the above-described examples. In addition, a person having ordinary skill in the art to which the present disclosure pertains can make various modifications and variations from this description. Therefore, one embodiment of the present disclosure should be understood only by the claims set forth below, and all equivalent modifications thereof can be said to fall within the scope of the technology of the present disclosure.

The invention claimed is:

1. A two-way row machine comprising:

a base frame arranged to be in contact with a floor;

a standing frame coupled to the upper surface of the base frame and arranged to stand in a vertical direction;

a foot support unit seated on an upper surface of the base frame;

a support unit fixed to the standing frame and the foot support unit, and adjustable in standing angle and height;

a pair of rotation units link-coupled to the base frame;

a pair of handle units coupled to one end of each of the pair of rotation units and formed to be adjustable in angle; and a pair of rotation stopper units coupled to the base frame, formed to be adjustable in height, and supporting the rotation units.

2. The two-way row machine of claim 1, wherein each of the rotation stopper units includes:

a link bracket coupled to one point of the base frame and formed in the shape of the Korean letter "ㄷ";

a support axis penetrating the link bracket;

a rotation link surrounding the support axis so as to be rotatable;

a first height protrusion protruding and extending from a point of the rotation link and formed to have a first length;

a second height protrusion protruding and extending from another point of the rotation link, and formed to have a second length;

a plurality of cushion portions respectively disposed on one end of each of the first height protrusion and the second height protrusion;

a first support arranged to be spaced apart from the link bracket by a first distance; and a second support arranged to be spaced apart from the link bracket by a second distance in a direction opposite to the first support.

3. The two-way row machine of claim 2, wherein the foot support unit includes:

a first bent plate seated on the upper surface of the base frame;

a pair of support plates arranged on the lower surface of the first bent plate to be spaced apart from each other by a predetermined distance;

a plurality of distance adjustment holes penetrating the first bent plate and the support plates; and a module inserted and fixed into the distance adjustment holes.

4. The two-way row machine of claim 3, wherein the module includes:

a bottom plate seated on the upper surface of the first bent plate;

a pair of distance fixing units penetrating the bottom plate and inserted into the distance adjustment holes to determine the position at which the bottom plate is fixed;

a second bent plate fixed to the bottom plate, standing upright, and bent at a right angle;

an inclined plate fixed to one end of the second bent plate at a preset angle and having a pair of protrusions at the upper end; and a footrest fixed to each of the protrusions of the inclined plate.

5. The two-way row machine of claim 4, wherein the support unit includes:

a link frame standing up from the footrest unit and formed to be inclined toward the upper part of the standing frame;

a first support sheet fixed to the upper part of the link frame;

an angle adjuster coupled to one point of the standing frame and one end of the link frame and formed to adjust the angle of the link frame;

a height adjuster coupled to one side of the link frame; and a second support sheet fixed to the height adjuster.

6. The two-way row machine of claim 1, wherein the height adjuster includes:

a pair of rack bars respectively coupled to either side of the link frame and having a plurality of grooves arranged in series;

a roller module including a plurality of rollers in contact with the pair of rack bars and coupled to one surface of the first support sheet;

a fixing board fixed to the roller module and inserted into at least one of the plurality of grooves to fix the positions of the first support sheet and the roller module; and an adjusting handle connected to the fixing board.

* * * * *